US010203656B2

(12) United States Patent
Rong et al.

(10) Patent No.: US 10,203,656 B2
(45) Date of Patent: Feb. 12, 2019

(54) PROCESSING CARTRIDGE

(71) Applicant: Ninestar Corporation, Zhuhai (CN)

(72) Inventors: Xueyu Rong, Zhuhai (CN); Jianxin Cao, Zhuhai (CN); Wanhong Huang, Zhuhai (CN); Jinlian Liu, Zhuhai (CN)

(73) Assignee: NINESTAR CORPORATION, Zhuhai (CN)

( * ) Notice: Subject to any disclaimer, the term of this patent is extended or adjusted under 35 U.S.C. 154(b) by 0 days.

(21) Appl. No.: 15/803,534

(22) Filed: Nov. 3, 2017

(65) Prior Publication Data

US 2018/0113417 A1 Apr. 26, 2018

Related U.S. Application Data

(63) Continuation of application No. PCT/CN2017/094515, filed on Jul. 26, 2017.

(30) Foreign Application Priority Data

Oct. 26, 2016 (CN) ..... 2016 2 1175898 U
Dec. 24, 2016 (CN) ..... 2016 2 1435861 U
Apr. 14, 2017 (CN) ..... 2017 1 0244798

(51) Int. Cl.
*G03G 21/16* (2006.01)
*G03G 21/18* (2006.01)
*G03G 15/08* (2006.01)

(52) U.S. Cl.
CPC ..... *G03G 21/1842* (2013.01); *G03G 15/08* (2013.01); *G03G 21/1633* (2013.01);
(Continued)

(58) Field of Classification Search
CPC ..... G03G 15/08; G03G 21/1633; G03G 21/1647; G03G 21/1842; G03G 21/1857;
(Continued)

(56) References Cited

U.S. PATENT DOCUMENTS 8,121,517 B2 * 2/2012 Asanuma ..... G03G 21/1853 399/110
2012/0321345 A1 12/2012 Shinoya et al.
2015/0261176 A1 9/2015 Moon et al.

FOREIGN PATENT DOCUMENTS

CN 102193472 A 9/2011
CN 103809420 A 5/2014
(Continued)

OTHER PUBLICATIONS

The State Intellectual Property Office of the People's Republic of China (SIPO) Search Report for PCT/CN2017/094515 dated Oct. 20, 2017 8 Pages.

*Primary Examiner* — Hoang Ngo
(74) *Attorney, Agent, or Firm* — Anova Law Group, PLLC

(57) ABSTRACT

A processing cartridge detachably mounted to an electronic imaging device is provided. The processing cartridge comprises a first housing, and a power receiving component configured to receive a driving force from a driving component of the electronic imaging device. The processing cartridge has a first position and a second position in the imaging device, and the processing cartridge is able to move in a longitudinal direction of the processing cartridge between the first position and the second position. When the processing cartridge is in the first position, the power receiving component disengages with the driving component, and the power receiving component is unable to receive the driving force from the driving component, and when the processing cartridge is in the second position, the power receiving component moves in an opposite direction and the power receiving component is able to receive the driving force from the driving component.

20 Claims, 9 Drawing Sheets

(52) U.S. Cl.
CPC ..... *G03G 21/1647* (2013.01); *G03G 21/1821* (2013.01); *G03G 21/1857* (2013.01); *G03G 21/1864* (2013.01); *G03G 2221/1657* (2013.01)

(58) Field of Classification Search
CPC ..... G03G 21/1821; G03G 21/1864; G03G 2221/1657
See application file for complete search history.

(56) References Cited

FOREIGN PATENT DOCUMENTS

| | | |
|---|---|---|
| CN | 205353581 U | 6/2016 |
| CN | 105785738 A | 7/2016 |
| CN | 205608400 | 9/2016 |

* cited by examiner

PROCESSING CARTRIDGE

CROSS-REFERENCES TO RELATED APPLICATIONS

This application is a continuation application of PCT Patent Application No. PCT/CN2017/094515, filed on Jul. 26, 2017, which claims the priority of Chinese Patent Application No. 201621175898.7, filed on Oct. 26, 2016, Chinese Patent Application No. 201621435861.3, filed on Dec. 24, 2016, and Chinese Patent Application No. 201710244798.8, filed on Apr. 14, 2017, the content of all of which is incorporated by reference in its entirety.

TECHNICAL FIELD

The present disclosure generally relates to the field of printing technology and, more particularly, to a processing cartridge.

BACKGROUND

An electronic imaging device is an apparatus for forming an image on a recording material by an electrophotographic image forming technique, such as an electrophotographic copying machine, a laser printer, an electrophotographic printer, a facsimile machine, a word processor, and so on.

The electronic imaging device generally includes a main body (not shown), and a processing cartridge detachably mounted to the main body. In the prior art, as shown in FIG. 1, a driving component 100 is provided in the main body of the electronic image forming apparatus, and a power receiving component 101 is provided at one end in the longitudinal direction (X direction) of the processing cartridge 1. In order to facilitate the engagement of the driving component 100 with the power receiving component 101, the power receiving component 101 is generally provided with a structure (universal joint), which can swing in any arbitrary direction with respect to the longitudinal direction of the processing cartridge 1. When the processing cartridge 1 is mounted to the main body, the power receiving component 101 can swing toward the mounting direction of the processing cartridge 1 with the help from a torsion spring.

Specifically, as shown in FIG. 2, the power receiving component 101 is connected to the hub 102, and the power receiving component 101 can swing in any arbitrary direction with respect to the axis of the hub 102. The power receiving component 101 can swing in the Y direction (the mounting direction of the processing cartridge 1) with the help from the torsion spring 103. The driving component 100 is brought in to contact with the power receiving component 101 during the mounting of the processing cartridge 1 to the electronic image forming apparatus and thereby causing the power receiving component 101 to swing in the opposite direction of the axis (the Y direction) of the hub 102. When the processing cartridge 1 is moving until the axis of the hub 102 and the axis of the drive component 100 is substantially coaxial, the power receiving component 101 can swing in the opposite of Y direction to a position where the shaft of the power receiving component 101 and the shaft of hub 102 are basically coaxial by the driving component 100. Then, the power receiving component 101 is engaged with the driving component 100, and the power receiving component 101 receives the rotational force from the driving component 100 and transmits the rotational force to the hub 102. The hub 102 drives other gears engaged with the gears on the peripheral surface of the hub 102, and the rotational force is transmitted to the other rotating components.

However, since the power receiving component 101 can swing with respect to the hub 102, the power receiving component 101 is easy to vibrate during the process of power transmission. As a result, the transmission of the rotational force is not stable enough, which affects the developing quality of the processing cartridge 1. In addition, the way the power receiving component 101 connecting with the hub is complicated and the assembling is not convenient.

The disclosed devices and methods are directed to at least partially alleviate one or more problems set forth above and to solve other problems in the art.

SUMMARY

One aspect of the present disclosure provides a processing cartridge detachably mounted to an electronic imaging device. The processing cartridge comprises a first housing and a power receiving component. The power receiving component is configured to receive a driving force from a driving component of the electronic imaging device and the power receiving component is located on a side of the first housing. The processing cartridge has a first position and a second position in the imaging device, and the processing cartridge moves in a longitudinal direction of the processing cartridge between the first position and the second position. When the processing cartridge is in the first position, the power receiving component disengages with the driving component, and the power receiving component is unable to receive the driving force from the driving component. When the processing cartridge is in the second position, the power receiving component moves in an opposite direction and the power receiving component is able to receive the driving force from the driving component.

Another aspect of the present disclosure provides a processing cartridge detachably mounted to an electronic imaging device. The processing cartridge comprises a first housing, a second housing, and a power receiving component. The power receiving component is configured to receive a driving force from a driving component of the electronic imaging device. The first housing is connected with the second housing, and the power receiving component is located on one side of the first housing. The first housing moves in a longitudinal direction of the second housing. When the first housing moves in the longitudinal direction of the second housing, the power receiving component disengages with the driving component and the power receiving component is unable to receive the driving force from the driving component. When the first housing moves in a direction opposite to the longitudinal direction of the second housing, the power receiving component engages with the driving component and the power receiving component is able to receive the driving force from the driving component.

Another aspect of the present disclosure provides a processing cartridge detachably mounted to an electronic imaging device. The processing cartridge comprises a first housing, a second housing, and a power receiving component. The power receiving component is configured to receive a driving force from a driving component of the electronic imaging device. The first housing is connected with the second housing and the power receiving component is located on a side of the first housing. The first housing moves in a longitudinal direction of the second housing.

When the first housing moves in a first direction along the longitudinal direction of the second housing, the power receiving component moves away from the driving component, and the power receiving component is unable to engage with the driving component to receive the driving force. When the first housing moves in a second direction opposite to the first direction, the power receiving component is able to engage with the driving component to receive the driving force.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 1:
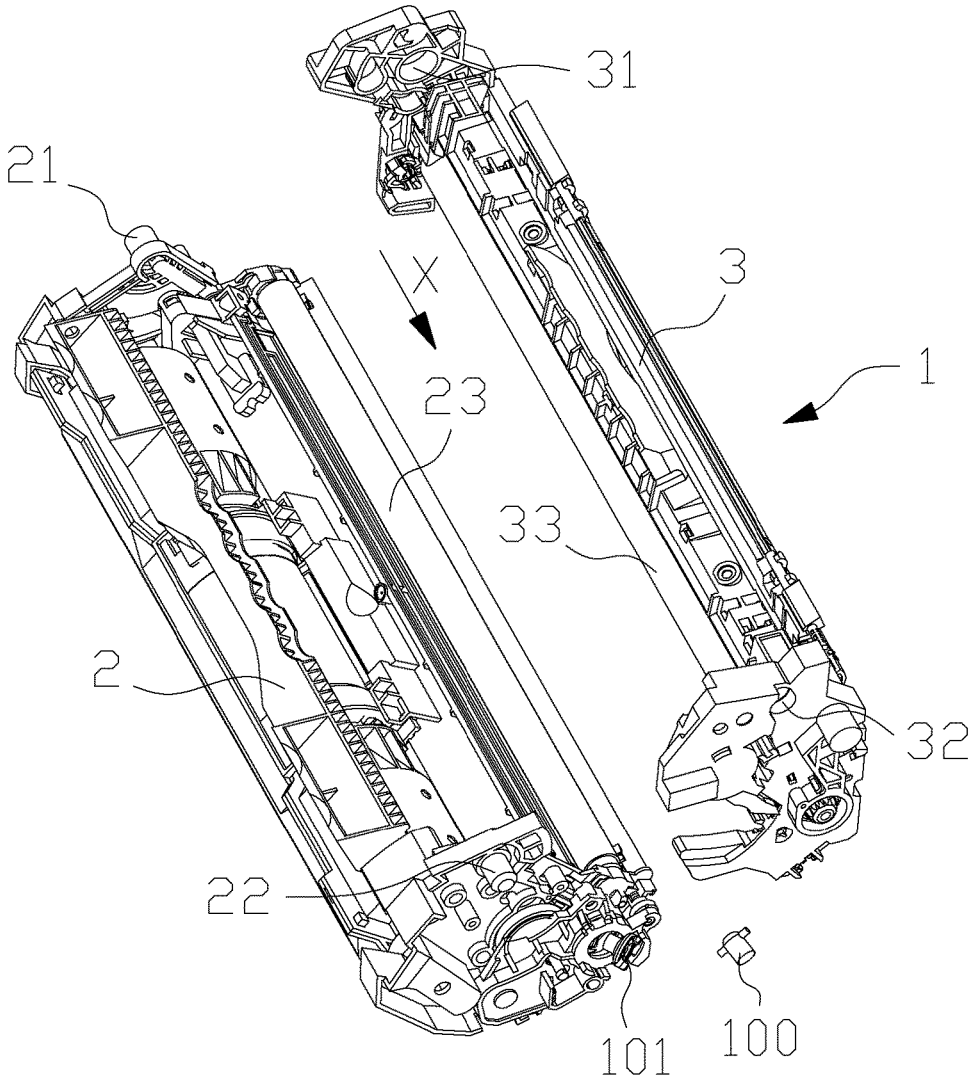
FIG. 1 shows a schematic diagram of a processing cartridge in the prior art.
Figure 2:
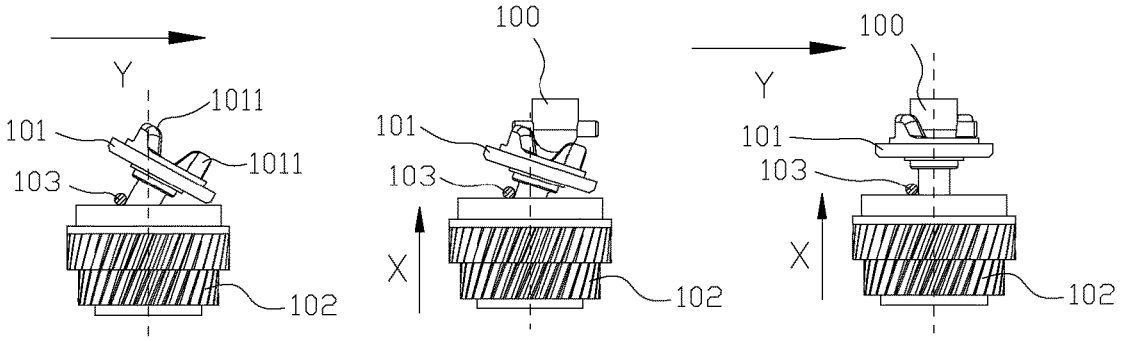
FIG. 2 shows a schematic representation of a prior art of a power receiving component with a driving component.

In prior art, as shown in FIG. 1, the first support shaft 21 and the second support shaft 22 are provided at both ends in the longitudinal direction (the direction parallel to the X direction) of the first housing 2 of the processing cartridge 1. Corresponding to the first support shaft 21 and the second support shaft 22, the first support hole 31 and the second support hole 32 are positioned at the two longitudinal (the direction parallel to the X direction) ends of the second housing 3 of the processing cartridge 1. The first support shaft 21 is supported on the first support hole 31 and the second support shaft 22 is supported on the second support hole 32. In this way, the first housing 2 may rotate and be supported on the second housing 3. It is preferred that the first housing 2 includes a developing unit 23 and the second housing 3 includes a photosensitive unit 33. When the processing cartridge 1 is in a non-operating state, the developing unit 23 of the first housing 2 is separated from the photosensitive unit 33 of the second housing 3, so that it prevents the developing unit 23 from being deformed by the photosensitive unit 33 for a long period of extrusion.

One embodiment of the present invention provides a processing cartridge structure. During the mounting of the processing cartridge in a main body of the electronic imaging device, a power receiving component of the processing cartridge may be engaged with a driving component in the electronic imaging device. The processing cartridge is simple in structure, convenient to assemble and stable in the transmission of rotating force.

The embodiment illustrated by using the first housing 2 is exemplary only.

Figure 3:
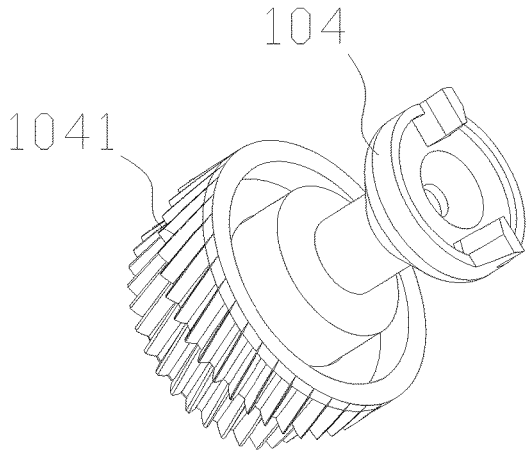
FIG. 3 shows a schematic diagram of a power receiving component according to disclosed embodiments.

As shown in FIG. 3, the power receiving component 104 and the hub 1041 in the embodiment may be integrated as a whole and the power receiving component 104 does not rotate around the hub 1041 in the process of transmitting power. Therefore, the transmission process of the rotating force is stable.

Figure 4:
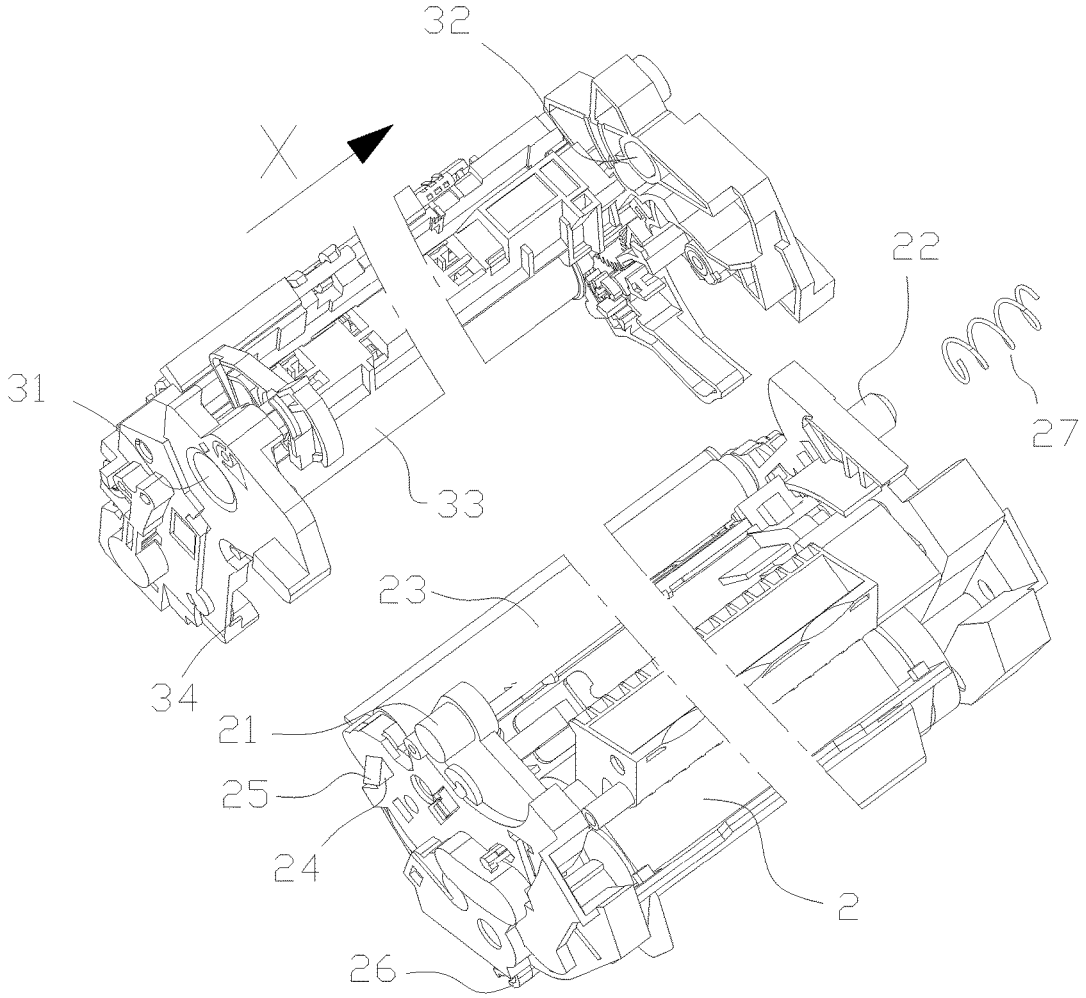
FIG. 4 shows a schematic diagram of the processing cartridge according to disclosed embodiments.

In FIG. 4, the power receiving component 104 may be located at one end of the first housing 2 in the X direction, and a first receiving component 24 may be located at the other end of the first housing 2 in the direction opposite to the X direction. Corresponding to the first receiving component 24 of the first housing 2, a first pushing component 34 may be located at one end of the second housing 3 in the direction opposite to the X direction. The first receiving component 24 preferably is a protrusion of the first housing 2 and the protrusion extends in a direction opposite to X direction. One side of the first receiving component 24, which is along the rotation direction of the first housing 2 when it rotates around the second housing 3, may be set to be an oblique sliding surface 25. When the first housing 2 is rotated by a set angle around the second housing 3, the oblique sliding surface 25 of the first receiving component 24 abuts against the first pushing component 34 of the second housing 3

Figure 5:
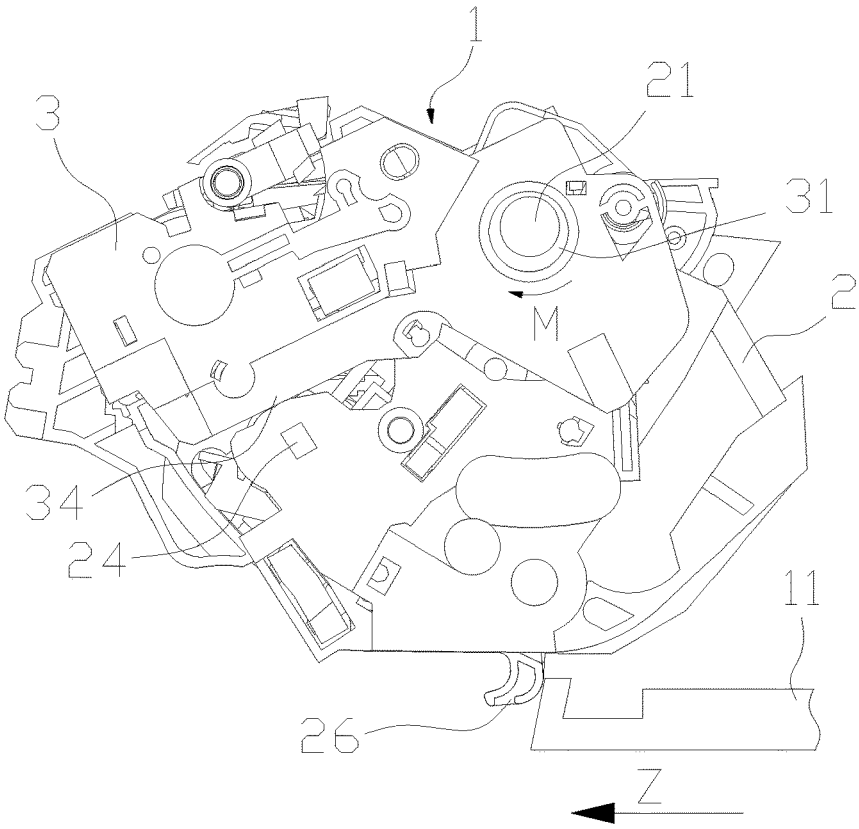
FIG. 5, FIG. 6, and FIG. 7 show schematic diagrams of the movement process of the processing cartridge according to disclosed embodiments.

As shown in FIG. 5, a second receiving component 26 may be provided on the first housing 2, and a second pushing component 11 capable of abutting against the second receiving component 26 may be located in the main body of the electronic imaging device. After the processing cartridge 1 is mounted to the main body of the electronic imaging device, by moving the second pushing component 11 in the Z direction, the second pushing component 11 abuts against the second receiving component 26 of the first housing 2, and pushes the first housing 2 to rotate around the second housing 3

Figure 6:
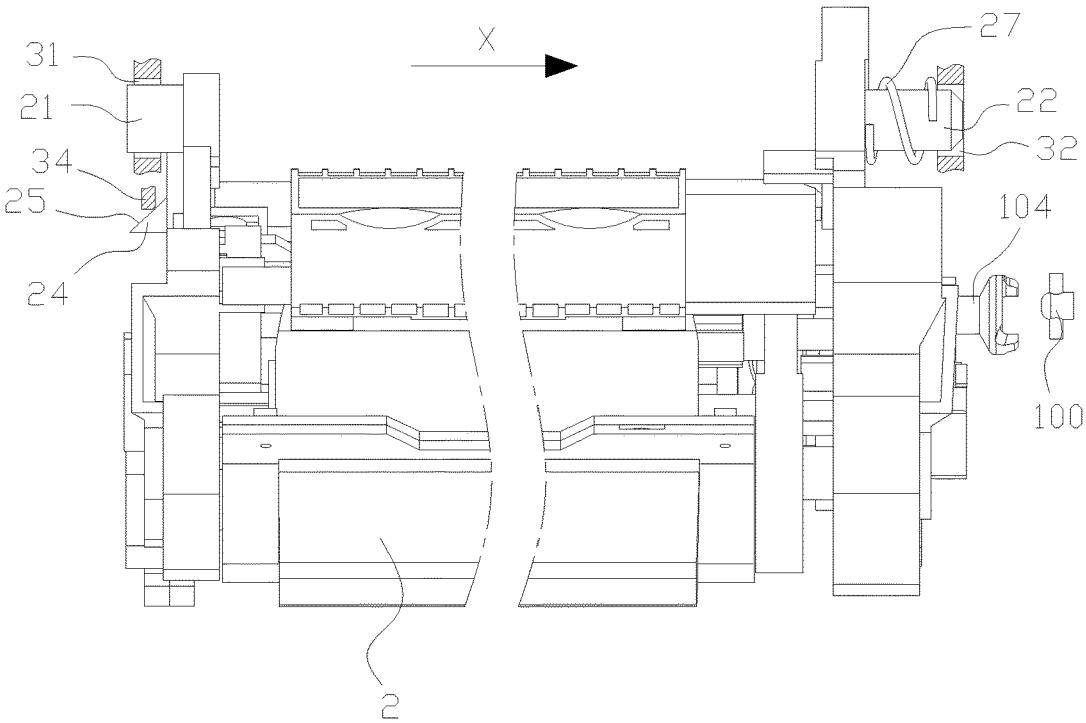
Figure 7:
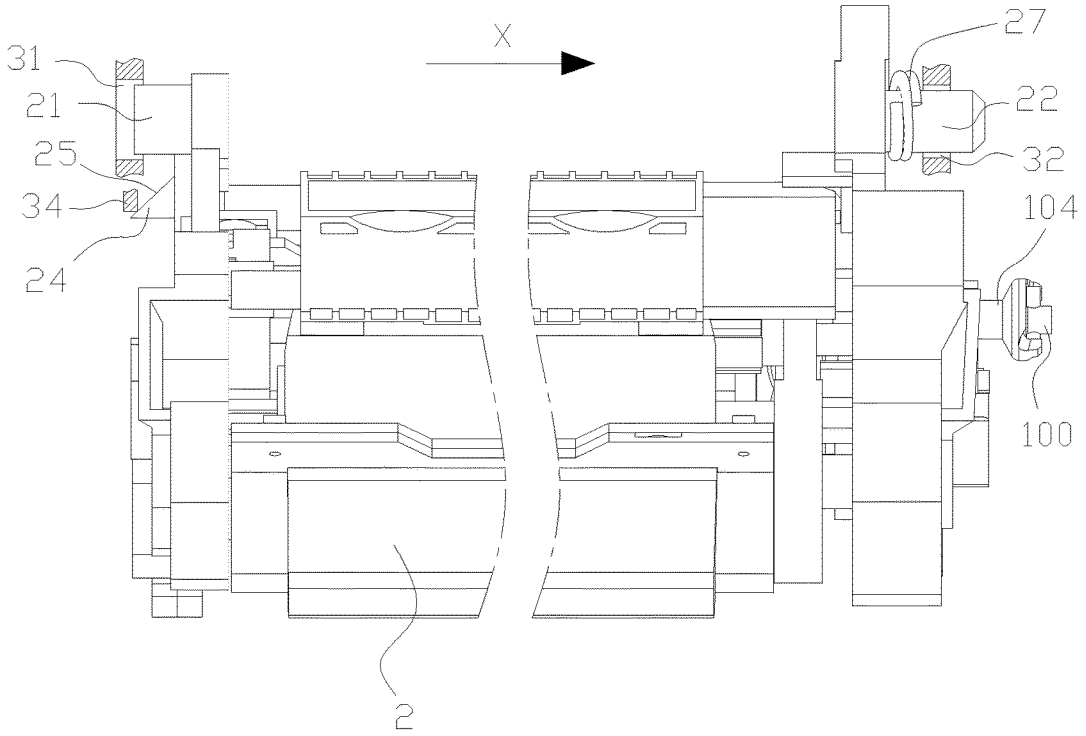

As shown in FIG. 6, when the second pushing component 11 pushes the first housing 2 to rotate by a set angle around the second housing 3, the oblique sliding surface 25 of the first receiving component 24 on the first housing 2 abuts against the first pushing component 34 on the second housing 3. The second pushing component 11 continuously push the first housing 2, as shown in FIG. 7, the first pushing component 34 applies a force on the oblique sliding surface 25 of the first receiving component 24, so that the first housing 2 may move in the X direction, and the power receiving component 104 located at one end in the X direction of the first housing 2 may be engaged with the driving component 100.

The present embodiment is not limited, and the first pushing component 34 may also be located on the main body of the electronic imaging device.

Preferably, the diameter of the first supporting hole 31 and the diameter of the second supporting hole 32 is respectively larger than the diameter of the first supporting shaft 21 and the diameter of the second supporting shaft 22. As a result, the first housing 2 may move relative to the second housing 3 in a direction perpendicular to the longitudinal direction of the second housing 3. A third receiving component (not shown) may also be located on the first housing 2, and a third pushing component (not shown) may be located on the second housing body 3. To take out the processing cartridge 1, a force may be applied to the second housing 3, and the second housing 3 moves relative to the first housing 2 in a direction perpendicular to the longitudinal direction of the second housing 3. Then, the third pushing component abuts against the third receiving component, and pushes the first housing 2 to move in the X direction. Thus, the power receiving component 104 may be disengaged from the driving component 100. The action mode between the third pushing component and the third receiving component may be referred to the action mode between the first pushing component and the first receiving component.

In addition, when taking out the processing cartridge 1, a force in the direction opposite to the X direction may be applied directly to the first housing 2. Thus, the first housing 2 moves in the direction opposite to the X direction, and the power receiving component 104 disengaged with the driving component 100.

Alternatively, as shown in FIG. 4, an elastic component 27 may be further located at one end of the first housing 2 in the X direction, the elastic element 27 applies an elastic force which is in the direction opposite to the X direction to the first housing 2. The elastic component 27 preferably is a spring, and the spring may be connected to the second supporting shaft 22 in a sleeved mode. One end of the first housing abuts against the first housing 2, and the other end of the second housing abuts against the second housing 3.

When the first housing 2 moves in the X direction, as shown in FIG. 7, the spring may be extruded and a force may be applied to the first housing 2 in the direction opposite to the X direction. When the second pushing component 11 does not push the first housing 2, the force applied by the spring on the first housing 2 enables the first housing 2 to move in the direction opposite to the X direction. Thus, the power receiving component 101 disengages with the driving component 100.

In addition, during the engagement of the power receiving component 101 of the processing cartridge 1 with the driving component 100, the power receiving component 101 may move slowly relative to the driving component 100 in the radial direction of the driving component 100. If the driving component 100 is in a rotating state when the power receiving component 101 engages with the driving component 100, the driving component 100 may first touch the end of the driving claws 1011 multiple times. The driving claws 1011 extend in the X direction from the power receiving component 101 and if the driving claws 1011 cannot avoid touching the driving component 100, the driving component 100 may damage the driving claws.

Figure 8:
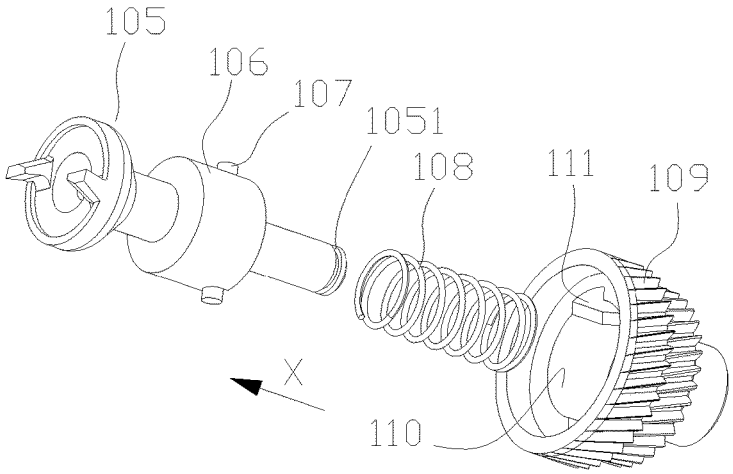
FIG. 8 and FIG. 9 show schematic diagrams of another power receiving component according to disclosed embodiments.

In this embodiment, in order to avoid the above situation, the driving force receiving component may be provided with a structure capable of extending and retracting relative to the hub in the axis direction of the hub. Specifically, as shown in FIG. 8, the power receiving component 105 may be provided with a positioning component 106 and a positioning groove 1051. The positioning component 106 may have a cylindrical structure, and the positioning groove 1051 may be located on the circumferential surface of one end of the power receiving component 105 in the direction opposite to the X direction. The pin 107 passes through the power receiving component 105 along the radial direction of the power receiving component 105 and the two ends of the pin 107 may protrude from the surface of the power receiving component 105. Corresponding to the two ends of the positioning component 106 and the pin 107 of the power receiving component 105, a positioning component 110 and a sliding groove 111 may be formed in the hub 109. The positioning component 110 may be a cylindrical hole extending in the axial direction of the hub, and the diameter of the positioning component 106 is basically the same as the diameter of the positioning component 106. The sliding groove 111 may be formed in the positioning component 110, and an elastic component 108 may be further located between the power receiving component 105 and the hub 109. The elastic element 108 preferably is a spring.

Figure 9:
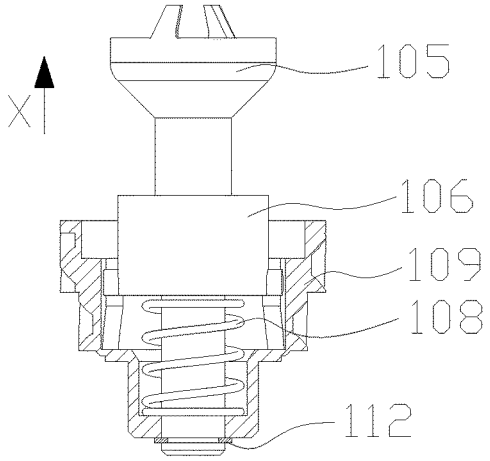

As shown in FIG. 9, during the mounting of the power receiving component 105 to the hub 109, a spring may be sleeved on the power receiving component 105. Then the power receiving component 105 may be installed in the positioning component 110 of the hub 109. By matching the positioning component 106 of the power receiving component 105 with the positioning component 110 of the hub 109, the power receiving component 105 slides in the X direction relative to the hub 109. The two ends of the pin 107 enter the sliding groove 111 of the hub 109, and the rotation of the power receiving component 105 around the hub 109 may be further limited. One end of the spring abuts against the power receiving component 105, and the other end abuts against the hub 109. Thus, a force in the X direction may be applied to the power receiving component 105, and the power receiving component 105 extends out along the X axis. When the positioning groove 1051 penetrates through the hub 109, the spring 112 may be installed on the positioning groove 1051, thus the power receiving component 105 may be positioned, and the power receiving component 105 may be prevented from being separated from the hub 109.

By providing the power receiving component with a structure that may extend axially relative to the hub 109 along the axial direction of the hub 109, when the driving claws of the power receiving component may be in contact with the driving component, the power receiving component may retract. Thus, the driving component may avoid the driving claws, and may be prevented from being damaged by the driving claws.

Figure 10:
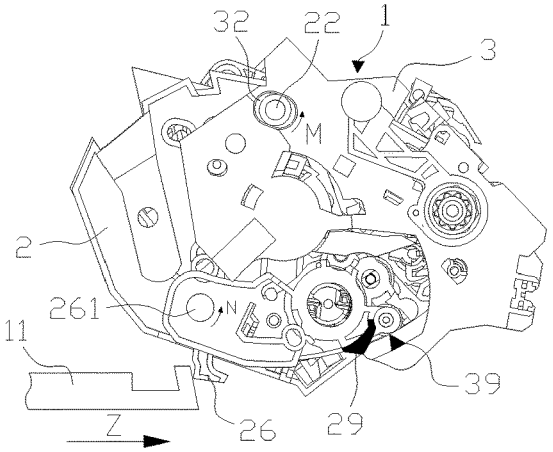
FIG. 10 and FIG. 11 show schematic diagrams of another processing cartridge movement process according to disclosed embodiments.
Figure 11:
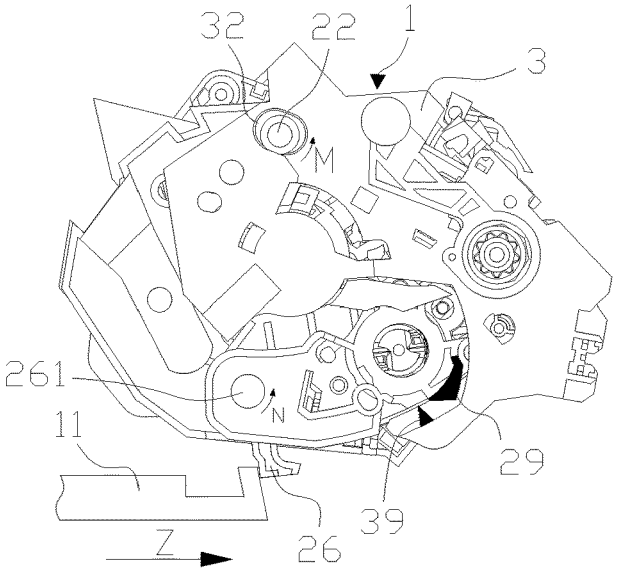

In addition, another structure may be used to prevent the driving component from damaging the driving claws of the power receiving component. As shown in FIGS. 10-11, the second receiving component 26 may rotate while being supported on the first housing 2 through a rotating shaft 261. An elastic component (not shown) may be further located between the first housing 2 and the second receiving component 26. The elastic component applies a force to the second receiving component 26, and the second receiving component 26 rotates around the rotating shaft 261 to a set position in the direction opposite to the N direction. The elastic component 26 preferably is a spring. A first abutting component 29 may be further provided on the first housing 2, and a second abutting component 39 may be further located on the second housing 3. The first abutting component 29 and the second abutting component 39 may be protrusions with certain elasticity.

When the second pushing component 11 pushes the first housing 2 to rotate to a set angle in the M direction around the second housing 3, the second abutting component 39 on the second housing 3 abuts against the first abutting component 29 on the first housing 2, and the rotation of the first housing 2 may be blocked. If the second pushing component 11 continues to move in the Z direction, since the first housing 2 does not rotate, the second pushing component 11 pushes the second receiving component 26 to rotate around the rotating shaft 261 in the N direction. Then the spring abutting against the second receiving component 26 is extruded, and the extrusion force may be transmitted to the second abutting component 39 through the first housing 2 and the first abutting component 29. While the second pushing component 11 moves along the Z direction continuously, the spring abutting against the second receiving component 26 is extruded more and more and the force between the first abutting component 29 and the second abutting component 39 is larger and larger. Thus, the deformation degree of the first abutting component 29 and the second abutting component 39 is larger and larger. After the first abutting component 29 and the second abutting component 39 may be deformed to a certain degree, the first abutting component 29 may directly cross over the second abutting component 39, and the blocking role of the second abutting component 39 on the first housing 2 disappears. Under the action of the spring abutting against the second receiving component 26, the first housing 2 moves rapidly to a preset position, and the power receiving component of the second housing 2 engages quickly with the driving component. Therefore, during the process that the power receiving component engages with the driving component, the number of contact times of the driving claws of the power receiving component with the driving component is reduced, and the driving component may be prevented from being damaged by the driving claws of the power receiving component.

Another embodiment of the present invention provides a processing cartridge structure. During the mounting of the processing cartridge in a main body of the electronic imaging device, a power receiving component of the processing cartridge may be engaged with a driving component in the electronic imaging device, the processing cartridge is simple in structure, convenient to assemble and stable in rotating force transmission.

According to the embodiment, the push component may be located on a first housing or a second housing in the main body of the electronic imaging device. After the processing cartridge is mounted to the electronic imaging device, by controlling the move of the pushing component around the first housing or the second housing, the first housing or the second housing may be pushed to move in the longitudinal direction, and the power receiving component may be engaged with the driving component.

The embodiment illustrated by using the first housing 2 is exemplary only. Some components of the structure in the figures are not shown.

Figure 12:
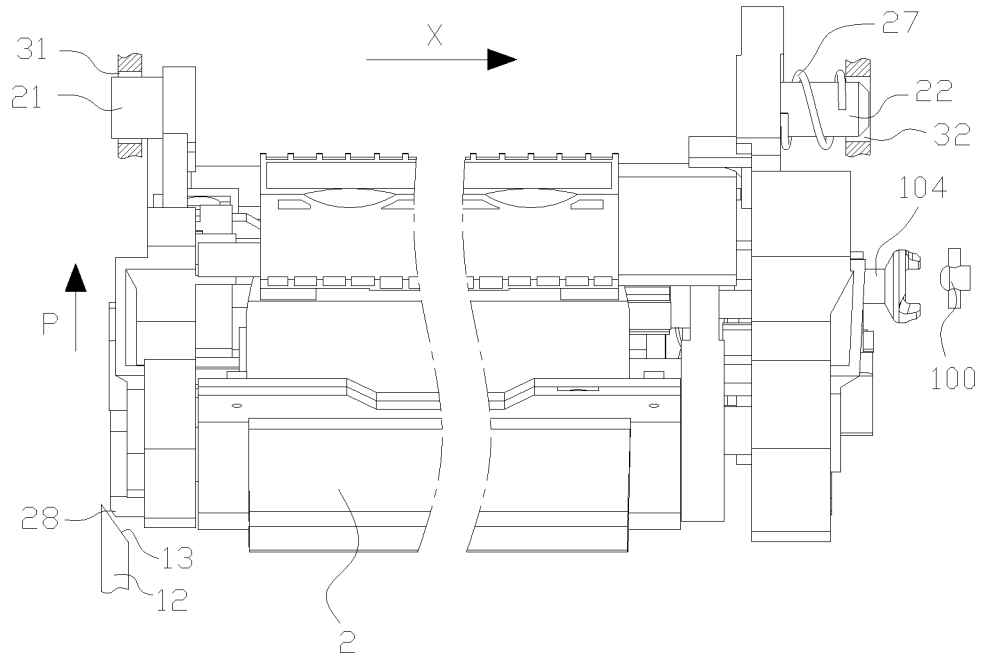
FIG. 12 and FIG. 13 show schematic diagrams of a processing cartridge according to disclosed embodiments.
Figure 13:
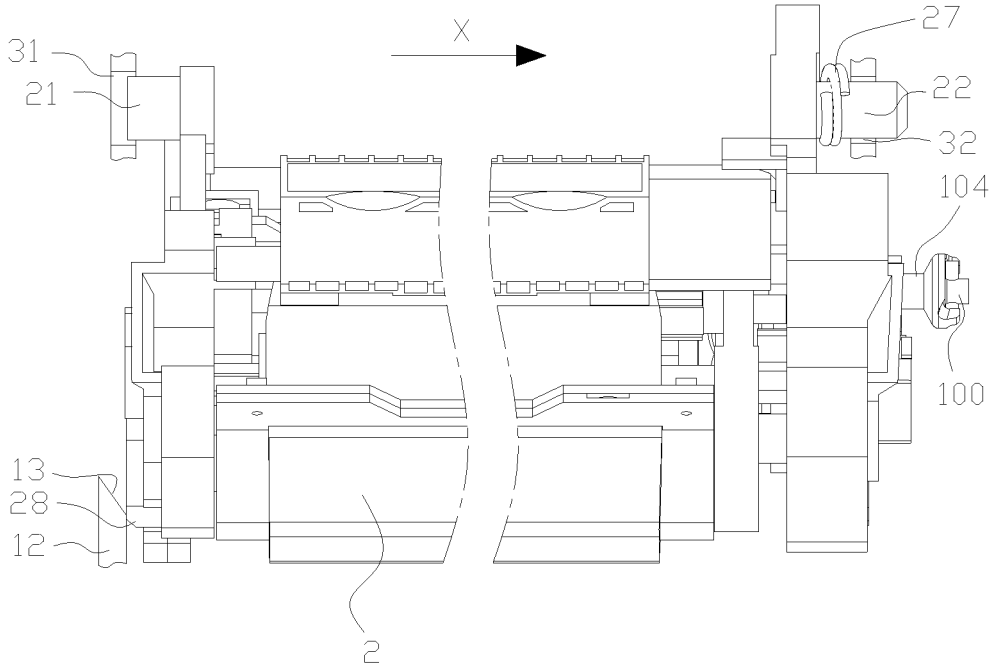

As shown in FIG. 12 and FIG. 13, a fourth receiving component 28 may be located on one side of the first housing 2 in the X direction, and a fourth pushing component 12 may be located in the main body of the electronic imaging device. The fourth pushing component 12 may have a push rod structure, and an oblique sliding surface 13 may be located at one end in the P direction. After the processing cartridge 1 is mounted to the electronic imaging device, by controlling the move of the fourth pushing component 12 in the P direction, the oblique sliding surface 13 of the fourth pushing component 12 abuts against the fourth receiving component 28 of the first housing 2. And the fourth pushing component 12 pushes the second housing 2 to move in the X direction, then the power receiving component 104 engages with the driving component 100.

The fourth pushing component 12 and the second pushing component 11 may be arranged in a linkage structure. Alternatively, the fourth pushing component 12 and the second pushing component 11 may be directly integrated as a whole. By setting the position of the second pushing component 11 and the position of the fourth pushing component 12, the second pushing component 11 pushes the first housing 2 to rotate by a preset angle around the second housing 3, and the fourth pushing component 12 pushes the first housing 2 to move along the X direction to a position where the power receiving component 104 engaged with the driving component 100. When the processing cartridge 1 needs to be taken out, the fourth pushing component 12 contracts in the opposite direction of the P direction. Thus, the first housing 2 may move in the opposite direction of the X direction, and the power receiving component 104 disengages from the driving component 100.

Alternatively, the fourth pushing component 12 and the door cover of the electronic imaging device may be arranged in a linkage structure, or directly be integrated as a whole. After the processing cartridge 1 is mounted to the main body of the electronic imaging device, when the door cover is closing, the fourth pushing component 12 extends out along the P direction, and pushes the first housing 2 to move in the X direction, so that the power receiving component 104 engages with the driving component 100. After the door cover is opened, the fourth pushing component contracts in opposite direction of the P direction, the first housing 2 may move in the opposite direction of the X direction, and the power receiving component 104 disengages from the driving component 100.

As shown in FIG. 3 and FIG. 12, an elastic component 27 may be further located at one end of the first housing 2 in the X direction, and the elastic element 27 applies an elastic force to the first housing 2 in the opposite direction of the X direction. The elastic component 27 preferably is a spring, and the spring may be connected to the second supporting shaft 22 in a sleeved mode. One end of the spring abuts against the first housing 2, and the other end of spring abuts against the second housing 3.

When the first housing 2 moves in the X direction, as shown in FIG. 7, the spring may be extruded, and a force may be applied to the first housing 2 in the opposite direction of the X direction. When the second pushing component 11 pushes the first housing 2, the force applied by the spring on the first housing 2 enables the first housing 2 to move in the direction opposite to the X direction, and the power receiving component 101 is separated from the driving component 100.

In present embodiment, the detailed structure of the power receiving component may be referred to the first embodiment and won't be described again.

In the above two embodiments, when the power receiving component is on the second housing, the structure of the second housing 3 may also be referred to the structure of the first housing 2. In addition, the shape and the position of the pushing component may be determined according to the specific structure of the processing cartridge, and the embodiment is not limited by the above two embodiments.

Another embodiment of the present invention provides a processing cartridge structure with a simple control mechanism. After the mounting of the processing cartridge in a main body of the electronic imaging device, a power receiving component in the electronic imaging device may engage with a driving component of the processing cartridge.

In present embodiment, the control mechanism may be arranged on a receiving component in the processing cartridge and on a pushing component in the electronic imaging device. When the processing cartridge is mounted to the electronic imaging device, the pushing component in the electronic imaging device abuts against the receiving component on the processing cartridge, and pushes the processing cartridge and/or the power receiving component on the processing cartridge to move relative to the driving component in the electronic imaging device. Thus, the power receiving component of the processing cartridge engages with or disengages from the driving component in the electronic imaging device.

The structure and the interaction process of the pushing component of the processing cartridge and the pushing component of the electronic imaging device are introduced below in detail.

Figure 14:
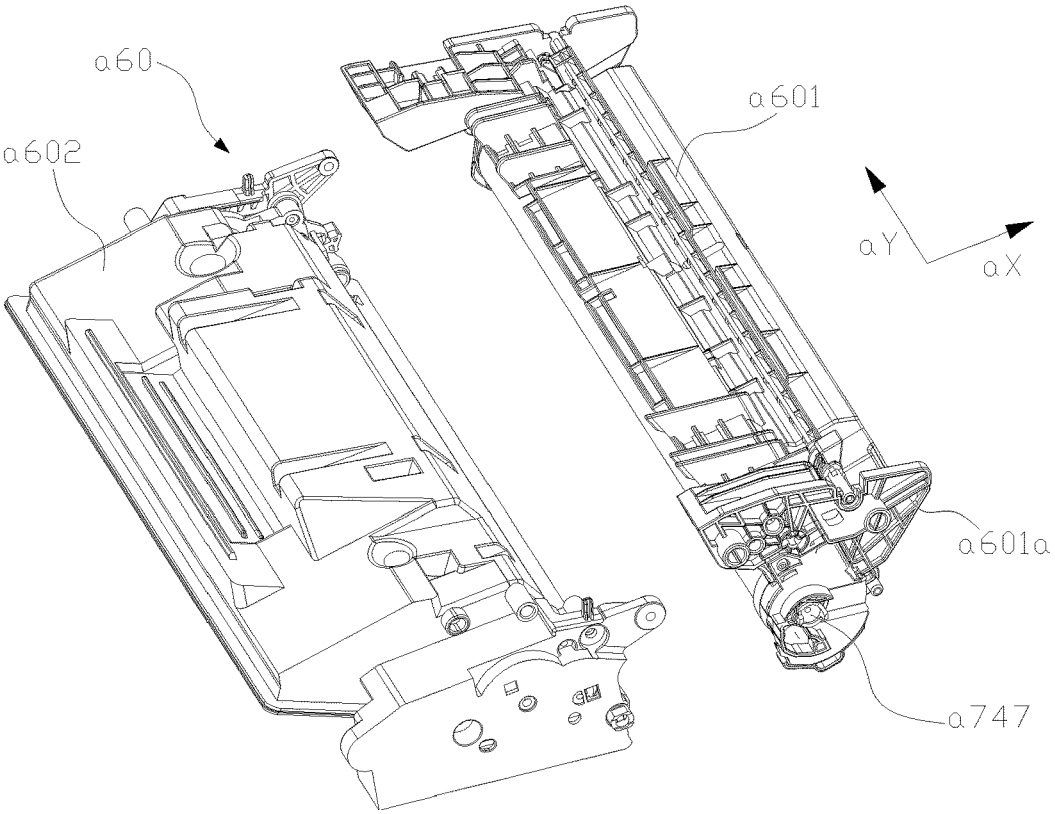
FIG. 14 and FIG. 15 show schematic diagrams of a processing cartridge according to disclosed embodiments.
Figure 15:
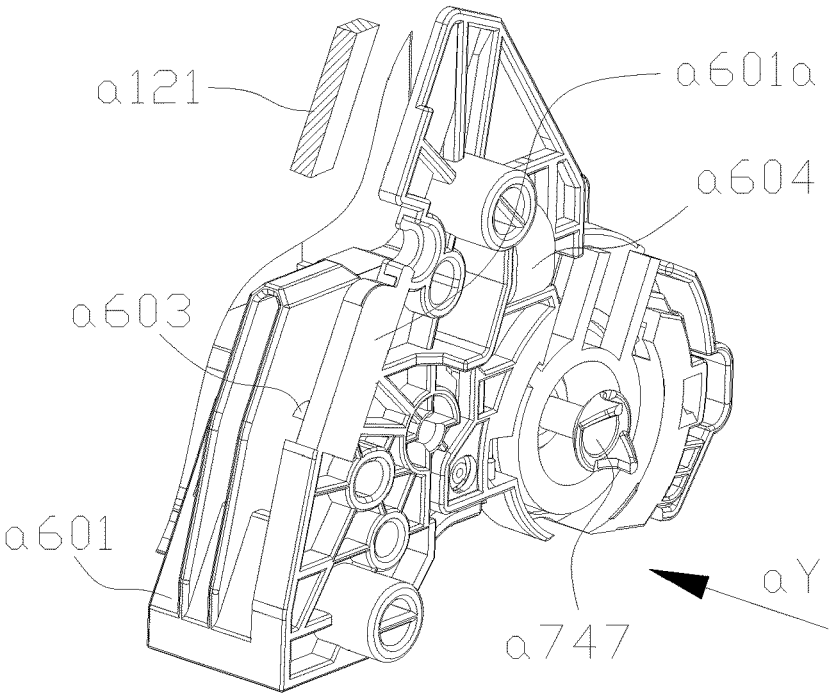

As shown in FIG. 14 and FIG. 15, a processing cartridge a60 includes a first housing a601 and a second housing a602. The first housing a601 may include a charging element, a cleaning element, and a photosensitive element, etc. The second housing a602 may include a developing element, a powder control element, a developer, etc. The power receiving component a747 may be located at one end in the longitudinal direction (parallel to the ay direction) of the processing cartridge a60. After the processing cartridge a60 is mounted to the electronic imaging device along the aX direction, the power receiving component a747 engages with the driving component 100, and then the rotating driving force may be transmitted to the processing cartridge a60. Thus, the engagement drives rotating elements (such as a photosensitive component, a developing component) in the processing cartridge a60 to operate and participates in the developing work.

In the embodiment, the pushing component on the processing cartridge may include a first pushing component and a second pushing component. During the installation of the pushing component in the electronic imaging device, the first pushing component abuts against the first receiving component and pushes the processing cartridge to move, and the second pushing component abuts against the second receiving component and pushes the processing cartridge to move. Specifically, as shown in FIG. 14 and FIG. 15, a side plate a601*a* may be located at the end of the processing cartridge a601, and may be located on the same side as the power receiving component a747 in the longitudinal direction of the processing cartridge a601. A first positioning protrusion a604 may be located on the side plate a601*a* of the first housing a601 for the first receiving component. A second positioning protrusion a603 may be located on the side plate a601*a* of the first housing a601 for the second receiving component. The first positioning protrusion a604 may be located on the side along the opposite direction of aY direction of the side plate a601*a* and may extend in the same direction. The second positioning protrusion a603 may be located on the side along the aY direction of the side plate a601*a* and may extend in the aY direction. The side (facing the aX direction) of the second positioning protrusion a603 includes an oblique sliding surface. The first pushing component in the electronic imaging device may be an inner wall a120 facing the first positioning protrusion a604, and the second pushing component may be a extending plate a121 which extends out of the inner wall facing the second positioning protrusion a603. The first positioning protrusion a604 may be arranged with an elastically extensible structure in the aY direction or may be directly made of an elastic material. Thus, the first positioning protrusion a604 may be prevented from blocking the processing cartridge a60 from moving to the second position.

Figure 16:
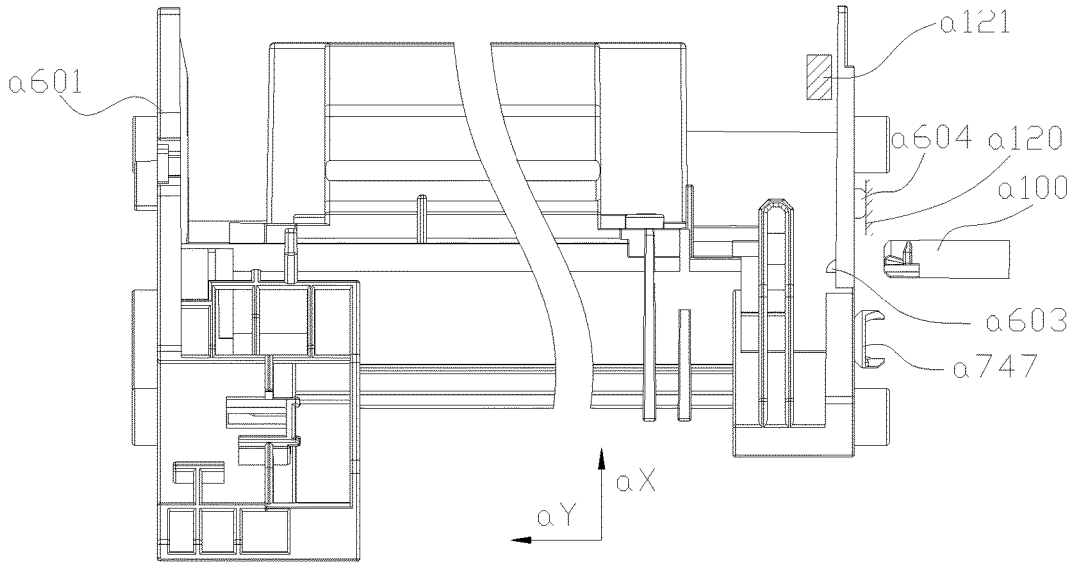
FIG. 16 and FIG. 17 show schematic diagrams of mounting process of the processing cartridge according to disclosed embodiments.
Figure 17:
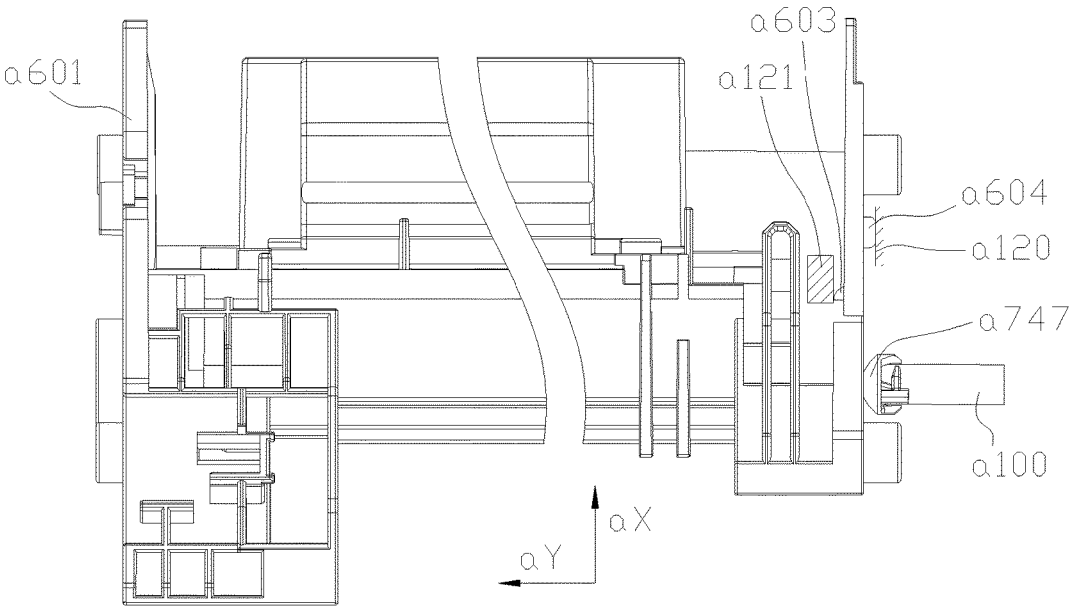

When the processing cartridge a60 is mounted to the electronic imaging device, as shown in FIG. 16, the inner wall a120 of the electronic imaging device abuts against the first positioning protrusion a604 of the processing cartridge a60. The inner wall a120 pushes the processing cartridge a60 to offset by a certain distance along the aY direction, and the processing cartridge may be located at the first position. At this moment, the power receiving component a747 also moves a certain distance in the aY direction and avoids the driving component a100. The second positioning protrusion a603 and the extending plate a121 may be overlapped in the aX direction. When the processing cartridge a60 moves to make the rotation axis of the power receiving component a747 close to the rotation axis of the driving component a100, and the power receiving component a747 and the driving component a100 are overlapped in the aY direction, the oblique sliding surface of the second positioning protrusion a603 of the processing cartridge a60 abuts against the extending plate a121 in the electronic imaging device. In addition, while pushing the processing cartridge a60 to move in the aX direction, the extending plate a121 pushes the second positioning protrusion a603 to move in the direction opposite to the aY direction. In other words, the extending plate a121 pushes the processing cartridge a60 to move in the direction opposite to the aY direction. Therefore, the power receiving component a747 may extend and engage with the driving component a100, and the processing cartridge a60 may be located at the second position, as shown in FIG. 17.

In the present embodiment, the first positioning protrusion a604 does not have to be configured to be an elastic structure or be made of an elastic material. Instead, a groove capable of accommodating the first pushing component may be located on the inner wall of the electronic imaging device, and the opening of the groove faces the aY direction. While the second positioning protrusion a603 of the processing cartridge is moving in the direction opposite to aY direction by the extending plate a121, the first positioning protrusion a604 enters the groove, and the first positioning protrusion a604 avoids preventing the processing cartridge from moving to the second position.

In addition, the first pushing component and the second pushing component may also be located at other positions of the processing cartridge. The first pushing component and the second pushing component may also be located at other positions in the electronic imaging device. More details can be determined according to the structure of the electronic imaging device and the processing cartridge.

When the processing cartridge needs to be taken out from the electronic imaging device, the processing cartridge may be affected by the extending plate a121, and it cannot move in the aY direction. Thus, the power receiving component a747 may be separated from the driving component a100. The power receiving component may be in an engaged state, which makes the processing cartridge being unable to move relative to the driving component in the aX direction, and makes the processing cartridge unable to be taken out from the electronic imaging device.

In order to avoid the above situation, the embodiment further provides a driving assembly. In the assembly, the rotation axis of the power receiving component may be kept parallel to the aY direction, and it may move a certain distance relative to the processing cartridge in the direction perpendicular to the aY direction. When the processing cartridge is taken out for a certain distance from the electronic imaging device in the direction opposite to the aX direction, the force from the extending plate a121 on the processing cartridge disappears, and the power receiving component may move relative to the processing cartridge along the aY direction. Therefore, the power receiving component may be separated from the driving component of the electronic imaging device and the processing cartridge may be taken out from the electronic imaging device.

Figure 18:
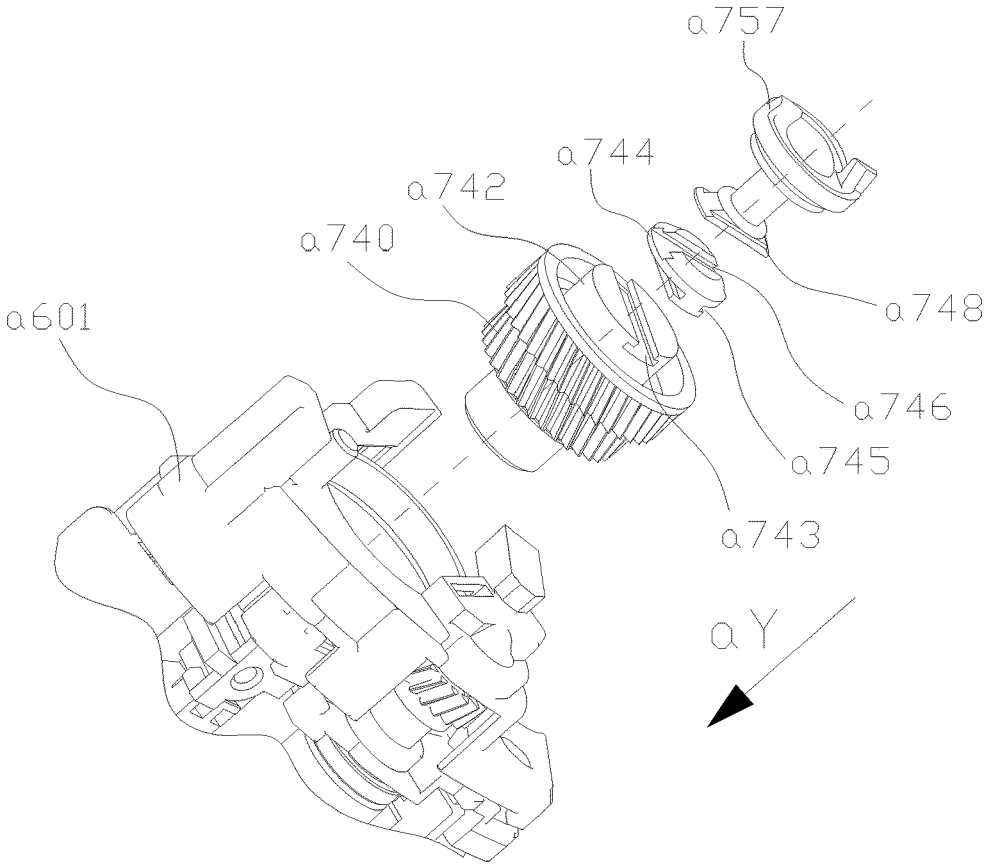
FIG. 18 and FIG. 19 show schematic diagrams of a drive assembly structure according to disclosed embodiments.

As shown in FIG. 18, the driving assembly may include a power receiving component a757, a hub a740, and a connecting component a744 for connecting the power receiving component a757 and the hub a740. The hub a740 may rotate while being supported on the first housing a601 and it may be used for receiving and transmitting the rotating force to the rotating component in the processing cartridge. A connecting component a742 may be located on the side of the hub a740 in the direction opposite to aY direction, and a first sliding groove a743 may be formed on one side of the connecting portion a742 in the direction opposite to the aY direction. A first sliding groove a743 may be formed on one side of the connecting portion a742 in the direction opposite to the aY direction. The longitudinal direction of the first sliding groove a743 may be perpendicular to the rotation axis of the hub a740 (the rotation axis of the hub a740 is parallel to the aY direction). A first sliding rail a745 which matches with the first sliding groove a743 may be located on one side of the connecting component a744, facing the connecting portion a742. By matching the first sliding rail a743 of the connecting component a742 with the first sliding rail a745 of the connecting component a744, the rotation axis of the connection component a744 is parallel to the rotation axis of the hub a740, and the connection component may also slide relative to the connecting portion a742 in a direction perpendicular to the axis of rotation of the hub a740. A second sliding groove a746 may also be formed on one side of the connecting component a744 in the direction opposite to the aY direction. A second sliding rail a748 matching the second sliding groove a746 may be located on one side of the power receiving component a757 in the aY direction. The longitudinal direction of the second sliding groove a746 may be perpendicular to the rotation axis of the hub a740, and may also be perpendicular to the longitudinal direction of the first sliding groove a743. By matching the second sliding groove a746 of the connecting component a744 with the second sliding rail a748 of the power receiving component a757, the rotation axis of the power receiving component a757 may be kept parallel to the rotation axis of the connection component a744. The power receiving component a757 may move relative to the connecting component a744 in a direction perpendicular to the axis of rotation of the power receiving component a757. That is, the axis of rotation of the power receiving component a757 may be parallel to the axis of rotation of the hub a740, and the power receiving component a757 may move relative to the hub a740 in a direction perpendicular to the axis of rotation of the hub a740.

Figure 19:
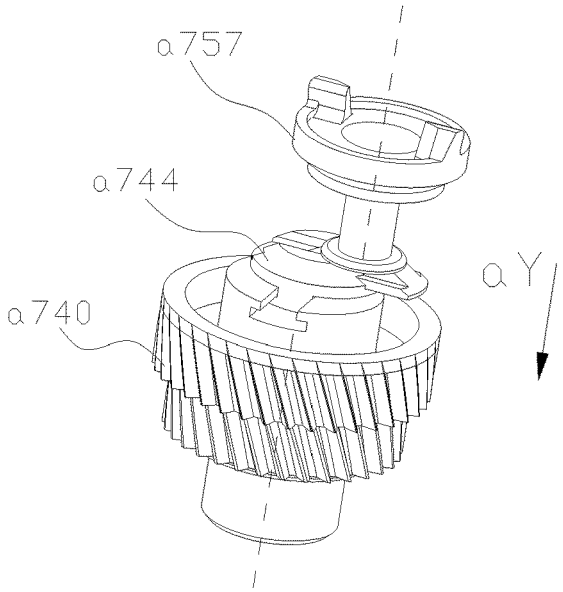

During the taking out or dismounting process of the processing cartridge from the electronic imaging device, when the processing cartridge moves in the direction opposite to the aX direction, as shown in FIG. 19, the power receiving component a757 may be still kept engaged with the driving component and the hub a740 moves along with the processing cartridge in a direction opposite to the aX direction. After the processing cartridge moves by a certain distance, the extending plate a121 located in the electronic imaging device may be separated from the second positioning protrusion a603 on the first housing a601. The first positioning protrusion a604 pushes the processing cartridge to move in the aY direction under the action of the inner wall a120 of the electronic imaging device. Thus, the power receiving component a757 also moves in the aY direction to a position where it separates from the driving component a100, and the processing cartridge may be smoothly taken out from the electronic imaging device.

Finally, it should be noted that the above embodiments are only used to illustrate the technical solutions of the present invention and are not limited thereto. Although the present invention has been described in detail with reference to the above embodiments, it should be understood by those of ordinary skill in the art that the technical scheme described in the embodiments can still be modified, some or all of the technical features can be equivalently replaced, and the modification or replacement does not make the essence of the corresponding technical solution deviate from the scope of the technical solutions of the embodiments of the present invention.

What is claimed is:

1. A processing cartridge detachably mounted to an electronic imaging device, the processing cartridge comprising:

a first housing; and a power receiving component configured to receive a driving force from a driving component of the electronic imaging device, the power receiving component being located on a side of the first housing, wherein the first housing has a first position and a second position in the imaging device, and the first housing moves in a longitudinal direction of the processing cartridge between the first position and the second position, when the first housing is in the first position, the power receiving component disengages with the driving component, and the power receiving component is unable to receive the driving force from the driving component, and when the first housing is in the second position, the power receiving component moves in an opposite direction and the power receiving component is able to receive the driving force from the driving component.

2. The processing cartridge according to claim 1, wherein the first housing further includes a first pushing component configured to push the first housing to move to the first position.

3. The processing cartridge according to claim 2, wherein:

the first housing includes a side plate on an end of the processing cartridge, the end of the processing cartridge being located on the same side as the power receiving component, the first receiving component is located on a first side of the side plate, and the first receiving component abuts against the first pushing component in the electronic image device and moves the first housing to the first position when the processing cartridge is mounted to the electronic imaging device.

4. The processing cartridge according to claim 3, wherein:

the first housing includes a second receiving component, the second receiving component being located on a second side of the side plate, and the second receiving component abuts against the second pushing component in the electronic image device and moves the first housing to the second position when the processing cartridge is mounted to the electronic imaging device.

5. The processing cartridge according to claim 4, wherein when the processing cartridge is mounted to the electronic imaging device, the first housing moves to the first position and then moves to the second position.

6. The processing cartridge according to claim 5, wherein the first receiving component is located in front of the second receiving component on the side plate along a direction in which the processing cartridge is mounted to the electronic imaging device, and the second receiving component is closer to the power receiving component than the first pushing component.

7. The processing cartridge according to claim 4, wherein the first receiving component is a first protrusion on the side plate and the first protrusion abuts against an inner wall of the electronic imaging device to push the first housing to the first position, and the second receiving component is a second protrusion on the side plate and the second protrusion abuts against an extending plate from the inner wall of the electronic imaging device to push the first housing to the second position.

8. The processing cartridge according to claim 7, wherein the first protrusion and the second protrusion protrude on the side plate in opposite directions.

9. The processing cartridge according to claim 7, wherein the first protrusion has an elastically extensible structure or is made of an elastic material, or the second protrusion has an oblique sliding surface abutting against the extending plate from the inner wall.

10. A processing cartridge detachably mounted to an electronic imaging device, the processing cartridge comprising:

a first housing;

a second housing; and a power receiving component configured to receive a driving force from a driving component of the electronic imaging device, the first housing being connected with the second housing, and the power receiving component being located on one side of the first housing, wherein the first housing moves in a longitudinal direction of the second housing, when the first housing moves in the longitudinal direction of the second housing, the power receiving component disengages with the driving component and the power receiving component is unable to receive the driving force from the driving component, and when the first housing moves in a direction opposite to the longitudinal direction of the second housing, the power receiving component engages with the driving component and the power receiving component is able to receive the driving force from the driving component.

11. The processing cartridge according to claim 10, wherein the first housing includes a receiving component and, when the receiving component is not pushed by an external force, the power receiving component is unable to receive the driving force from the driving component.

12. The processing cartridge according to claim 11, wherein an elastic component is located between the first housing and the second housing and, when the pushing component is not pushed by the external force, the elastic component separates the power receiving component from the driving component.

13. The processing cartridge according to claim 12, wherein the electronic imaging device includes a pushing component, the pushing component abutting against the receiving component, and when the processing cartridge is mounted to the electronic imaging device, the pushing component abuts against the receiving component to move the first housing in the longitudinal direction of the second housing, and the power receiving component is able to receive driving force from the driving component.

14. The processing cartridge according to claim 13, wherein the pushing component is located at one end of the first housing opposite to the power receiving component on the first housing.

15. The processing cartridge according to claim 14, wherein the first housing includes a second receiving component, the receiving component is the second receiving component, the pushing component is the second pushing component, the first housing further includes a first receiving component, the second housing includes a first pushing component corresponding to the first receiving component, and the first receiving component and the second receiving component are located at the same end of the first housing, and when the processing cartridge is mounted to the electronic imaging device, the second pushing component abuts against the second receiving component causing the first housing to rotate around the second housing, and the first receiving component abuts against the first pushing component causing the first housing to move in the longitudinal direction of the second housing.

16. The processing cartridge according to claim 15, wherein after the processing cartridge is mounted to the electronic imaging device, the second receiving component is located at a bottom of the processing cartridge, and the first receiving component is located higher than the second receiving component, and the first receiving component is located in front of the second receiving component along a pushing direction of the second pushing component.

17. A processing cartridge detachably mounted to an electronic imaging device, the processing cartridge comprising:

a first housing;

a second housing; and a power receiving component configured to receive a driving force from a driving component of the electronic imaging device, the first housing being connected with the second housing and the power receiving component being located on a side of the first housing, wherein the first housing moves in a longitudinal direction of the second housing, wherein when the first housing moves in a first direction along the longitudinal direction of the second housing, the power receiving component moves away from the driving component, and the power receiving component is unable to engage with the driving component to receive the driving force, and wherein when the first housing moves in a second direction opposite to the first direction, the power receiving component is able to engage with the driving component to receive the driving force.

18. The processing cartridge according to claim 17, wherein the first housing includes a receiving component, and when the receiving component is not pushed by an external force, the power receiving component is located away from the driving component and the power receiving component is unable to engage with the driving component to receive the driving force.

19. The processing cartridge according to claim 18, wherein the electronic imaging device includes a pushing component abutting against the receiving component, wherein when the processing cartridge is mounted to the electronic imaging device, the pushing component abuts against the receiving component causing the first housing to rotate around the second housing.

20. The processing cartridge according to claim 19, wherein the first housing includes a second receiving component, the receiving component is the second receiving component, the pushing component is the second pushing component, the first housing further includes a first receiving component, the second housing includes a first pushing component corresponding to the first receiving component, the first receiving component and the second receiving component are located on a same side of the first housing, and when the second pushing component abuts against the second receiving component causing the first housing to rotate around the second housing, the first receiving component abuts against the first pushing component causing the first housing to move along the longitudinal direction of the second housing, and the power receiving component engages with the driving component to receive the driving force.

* * * * *